United States Patent [19]

Kampiziones

[11] 4,207,041

[45] Jun. 10, 1980

[54] MOBILE CEMENT BLOCK MAKING MACHINE

[76] Inventor: Theodore G. Kampiziones, Jeffries La., Florence, S.C. 29501

[21] Appl. No.: 932,335

[22] Filed: Aug. 9, 1978

[51] Int. Cl.[2] ..... B28B 1/08; B28B 17/00

[52] U.S. Cl. ..... 425/62; 425/64; 425/155; 425/163

[58] Field of Search ..... 425/62, 63, 64, 155, 425/163

[56] References Cited

U.S. PATENT DOCUMENTS

| | | | |
|---|---|---|---|
| 937,781 | 10/1909 | Eddy | 425/63 |
| 2,270,829 | 1/1942 | Wellnitz | 425/260 X |
| 2,298,458 | 10/1942 | Blackwell | 425/346 |
| 2,396,999 | 3/1946 | George | 425/182 |
| 2,431,034 | 11/1947 | Gelbman | 425/155 |
| 2,524,683 | 10/1950 | Sumpf | 425/62 |
| 2,859,502 | 11/1958 | Brown | 425/253 X |
| 2,957,222 | 10/1960 | Zmania et al. | 425/155 X |
| 2,985,935 | 5/1961 | Wellnitz | 425/155 |
| 3,181,222 | 5/1965 | Palmer | 425/111 |
| 3,679,340 | 7/1972 | Springs | 425/163 |
| 3,887,685 | 6/1975 | Stelzmuller | 425/260 |
| 4,063,859 | 12/1977 | Halle et al. | 425/139 |

FOREIGN PATENT DOCUMENTS

| | | | |
|---|---|---|---|
| 622855 | 1/1963 | Belgium | 425/62 |
| 878620 | 6/1953 | Fed. Rep. of Germany | 425/62 |
| 53326 | 6/1967 | Poland | 425/62 |
| 791625 | 3/1958 | United Kingdom | 425/62 |
| 823250 | 11/1959 | United Kingdom | 425/62 |
| 875705 | 8/1961 | United Kingdom | 425/62 |
| 118413 | 2/1958 | U.S.S.R. | 425/62 |

*Primary Examiner*—Philip Anderson

*Attorney, Agent, or Firm*—Clarence A. O'Brien; Harvey B. Jacobson

[57] ABSTRACT

A machine for making cement blocks is provided which may be conveniently used on the site of a building construction. The device provides female dies into which fluid cement or flowable concrete mix is distributed whereupon male dies are lowered to properly form the cement into blocks. The male and female dies are then conveniently lifted above the height of the blocks and the entire machine moves forward a specified amount whereupon the female dies are lowered and the process begins again. The entire procedure may be carried out automatically in response to a preprogrammed sequence of events, or the process may be carried out by manual manipulation of a control panel.

14 Claims, 9 Drawing Figures

MOBILE CEMENT BLOCK MAKING MACHINE

BACKGROUND OF THE DISCLOSURE

1. Field of the Invention

The invention relates to apparatus for forming concrete into various shaped products wherein the apparatus is of a portable nature.

2. Description of the Prior Art

Shaped cement products are typically formed by pouring fluid cement into an open mold having the form of the desired product and allowing the cement to set and harden within the mold. The pouring of the fluid cement into the mold, distribution and tamping of the fluid cement within the mold, and the removal of the hardened product from the mold has generally been a time consuming and expensive process requiring substantial labor. Moreover, in the past a large number of molds had to be utilized in order to produce a plurality of finished products at the same time, thus requiring a large investment in molds or resulting in slowed production because of the unavailability of sufficient molds.

Also, in the past due to the large size of the apparatus necessary to produce a sufficient quantity of blocks, the blocks were necessarily produced at one location and, after curing, shipped to a point where they were needed for construction of a structure. This necessitated a permanent building and transportation of the product to a curing room for quickly curing the blocks in order to move them rapidly through the processing plant. In order to provide for inexpensive blocks, transportation and curing procedures had to be hastened. The movement of the uncured product and the quick curing process of the cement blocks would provide a product which was inferior to a product which is produced by the longer natural curing method of allowing air and sun curing of the cement for a period of up to twenty-eight days.

Examples of prior art block forming machines include U.S. Pat. No. 4,063,859, issued to Halle et al. This reference shows a stationary apparatus for producing shaped concrete products wherein there is included a novel stacker for the concrete blocks. U.S. Pat. No. 3,887,685, issued to Stelzmuller, shows an automatic feed block molding press which is designed to compress granular material into blocks especially electrode blocks. U.S. Pat. No. 3,181,222, issued to Palmer discloses a machine for manufacture of prestressed concrete conduit which uses a unique mold which is resiliently mounted so that high pressure compaction of the concrete will not affect the mold. U.S. Pat. No. 3,142,105. issued to Weir et al, shows a machine for making adobe blocks wherein a distributing mechanism is moved forwardly over a set of molds. The device is designed to provide a mobile completely self-contained machine which will scoop up soil and carry on all necessary mixing to produce mud and distribute the mud in forms for adobe blocks. In the Weir device, material is disposed within the forms and then the forms are lifted to leave a series of blocks to air dry. This machine, however, does not contemplate the more sophisticated requirements necessary in producing concrete blocks and also is not adapted for automatic operation. U.S. Pat. No. 2,859,502, issued to Brown, Jr., shows a a block molding machine which uses two sets of dies, one set of dies being filled with liquid cement and vibrated and tamped while a second set of dies having been vibrated and tamped, is manipulated to eject its blocks upon a seasoning table. This machine is a stationary device and is designed for use in a plant having a special room for curing the blocks. Further devices which demonstrate various techniques for distributing liquid cement and producing blocks include U.S. Pat. Nos. 2,298,458, 2,396,999 and 2,270,829.

SUMMARY OF THE INVENTION

My machine provides a high volume cement product molding apparatus with multiple products capability. It may produce any type of cement product up to 1000 lbs. total weight in 15 to 20 seconds in one stroke of the machine.

A primary object of the device is to provide a cement forming machine which is portable and therefore amenable to use on a distant job site where it would be expensive and inconvenient to transport preformed cement products.

A further object of the invention is to provide a machine which is fully automatic and requires no manual aids in production of cement products. After depositing one load of cement products, the machine lifts its dies from the surface on which they rest and moves itself forward to produce a second load of products. In this manner, the necessity for conveyors and other means of disposing of the product after formed is obviated. Also, in this manner the cement products may be allowed to cure in the open air, which has been found to produce a stronger product than those in which the curing is artificially speeded up by the use of chemical additives.

Yet a still further object of the present invention is to provide a machine which vibrates and presses the liquid cement mixture at the same time on a hard surface area thus saving a great deal of time over the standard method of sequential vibration and pressing or tamping of the mixture.

A still further object of the present invention is to provide a machine which may be run in an automatic cycle requiring no manual operations or run in a manual cycle wherein each operation of the machine may be manually commanded and run individually.

Yet a still further object of the present invention is to provide a cement forming machine wherein the machine may be removed and the formed cement remains stationary in order to avoid the potential harm which may be done to newly formed cement products when they are moved from place to place prior to the full curing thereof, such as when newly formed blocks are transported to a curing room.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
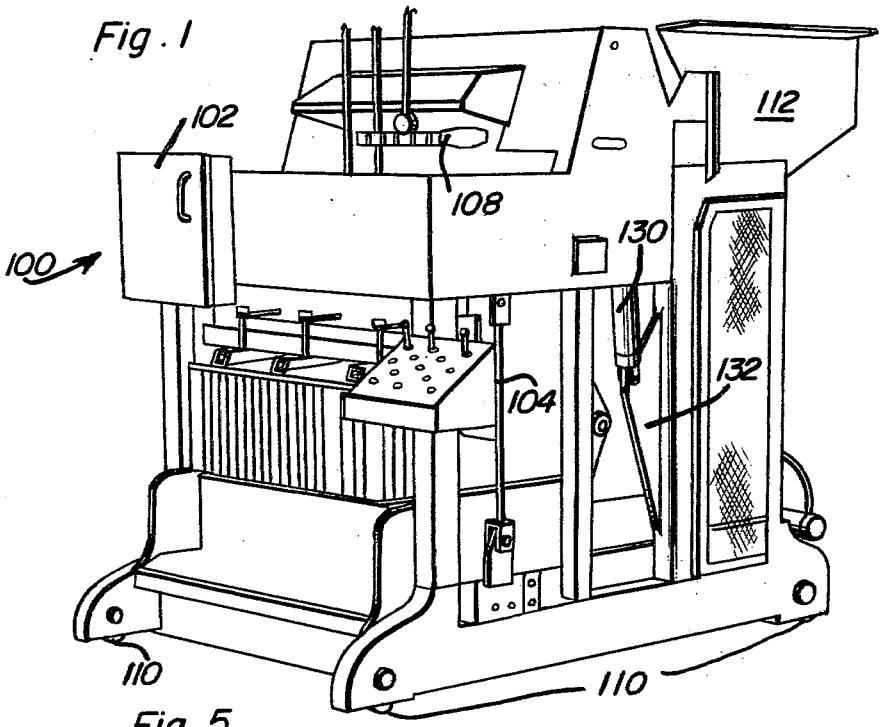
FIG. 1 is a perspective view of the cement forming machine.

Now with reference to FIGS. 1-4, the structure of the cement forming machine of the present invention will be set forth wherein the machine itself is designated by the numeral 100. The machine includes a control box 102 which encloses the automatic control elements and a control panel 104 which includes various joy sticks and button controls for manual operation of the machine. Located conveniently to the rear of manual control panel 104 is the operator's seat 106, which is for use by an operator when the machine is to be run in the manual mode. A housing 108 is also conveniently provided on the top of the machine and encloses electric valves for automatic operation of the hydraulic system of the machine. The entire machine rests and is movable upon wheels 110.

Figure 2:
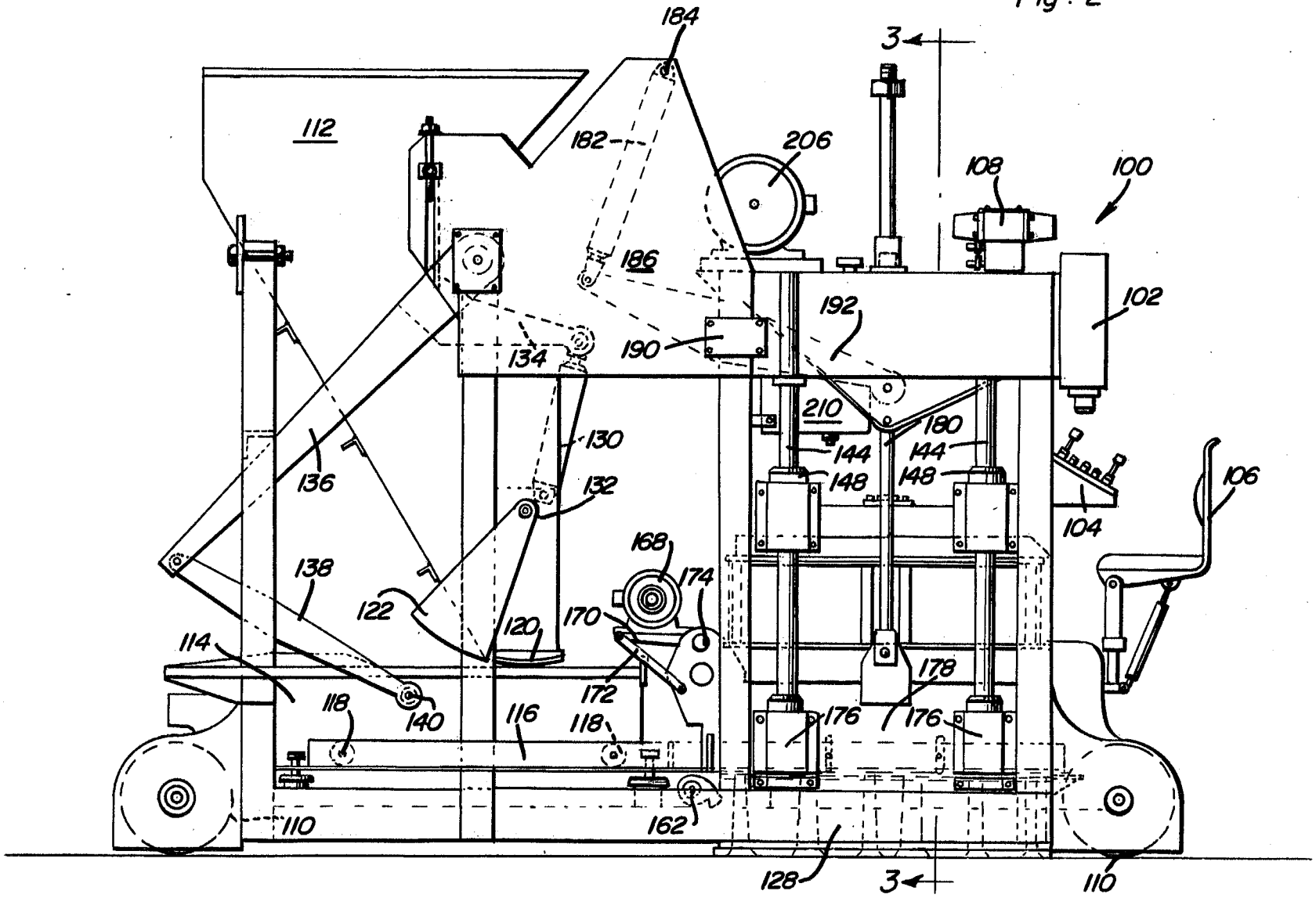
FIG. 2 is an elevational side view of the cement forming machine.
Figure 3:
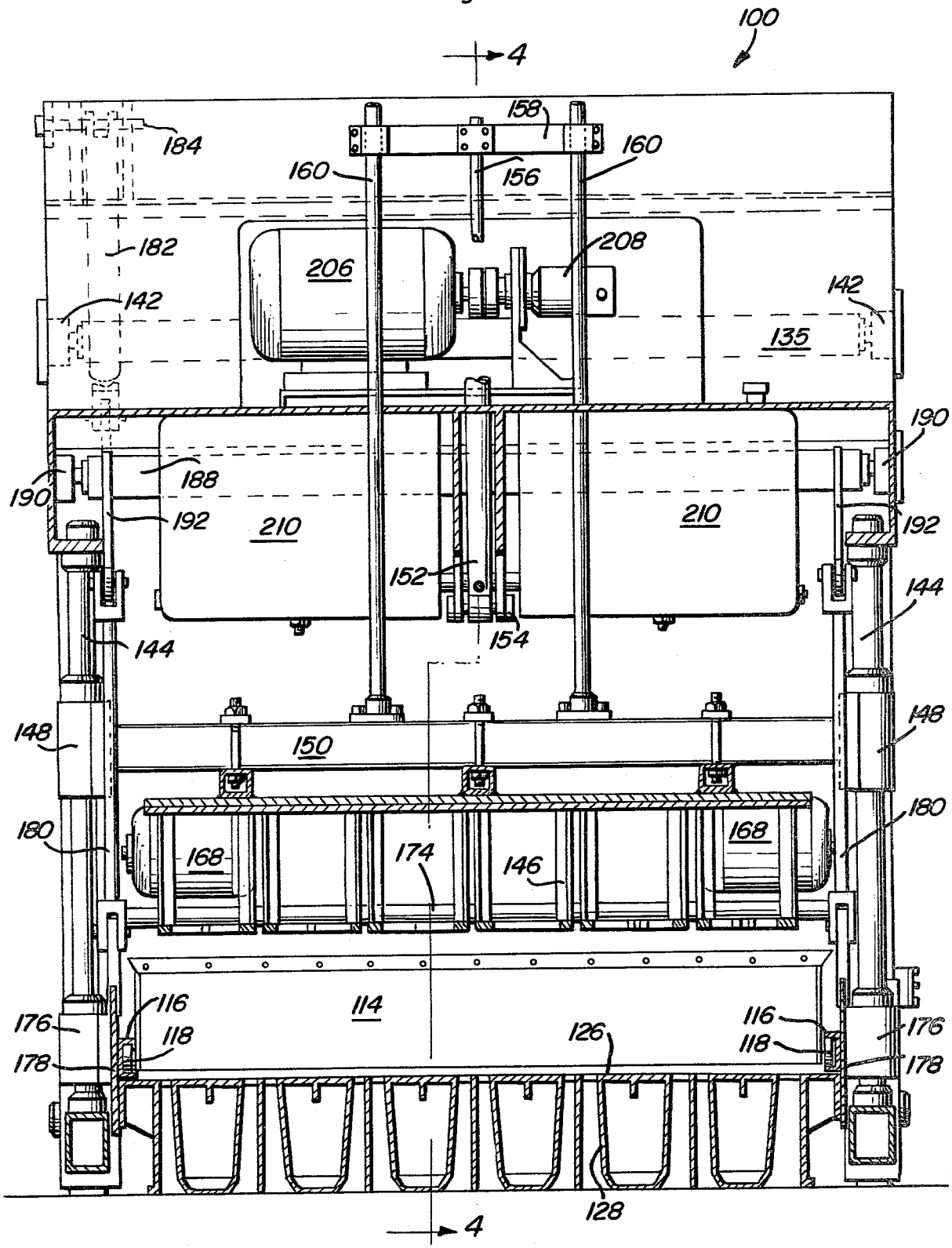
FIG. 3 is an elevational sectional view taken substantially along a plane passing through section line 3—3 of FIG. 2.
Figure 4:
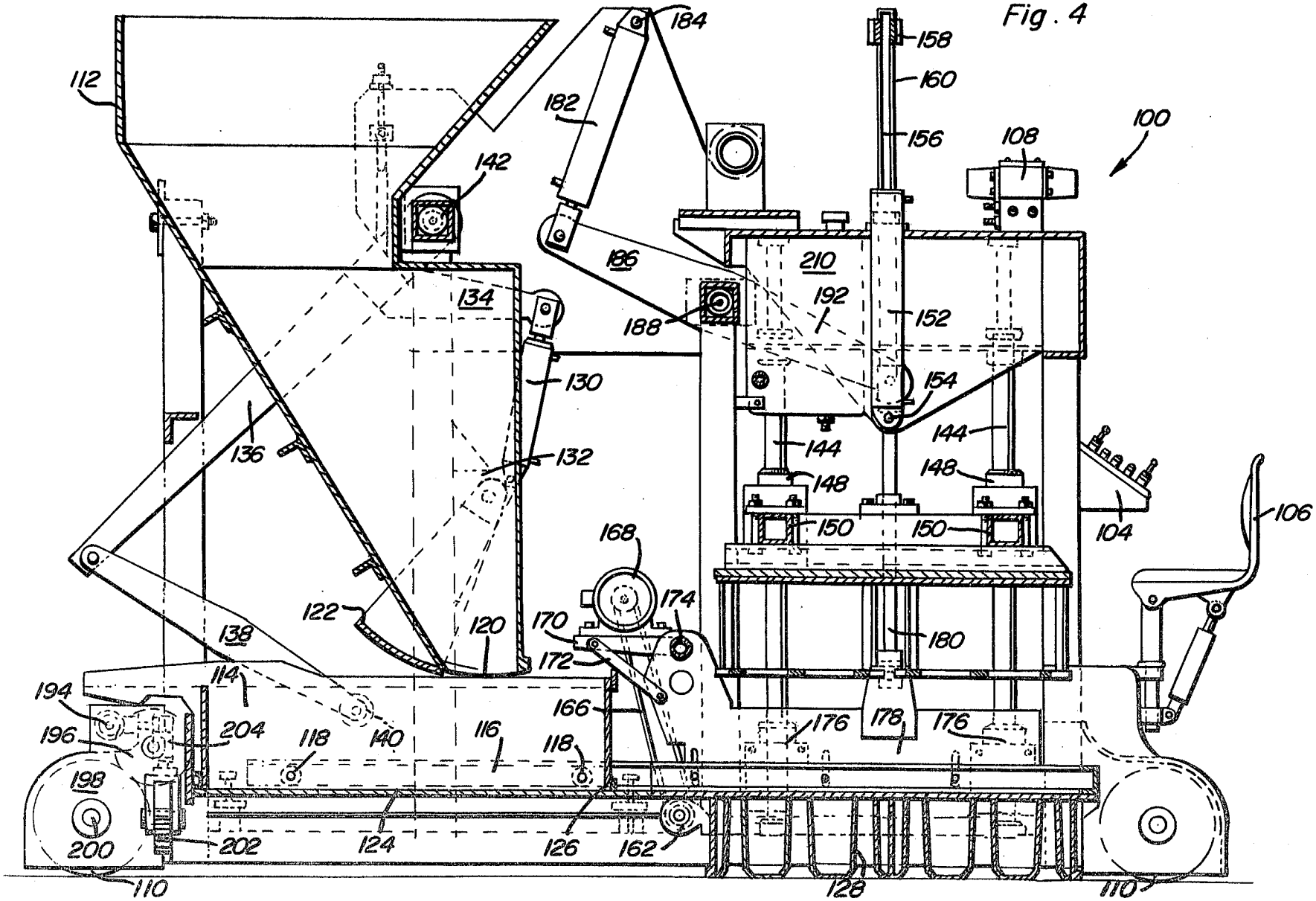
FIG. 4 is an elevational sectional view taken substantially along a plane passing through section line 4—4 of FIG. 3.

As seen most clearly in FIGS. 2 and 4, a hopper 112 is provided for receiving liquid cement. This hopper is preferably made of heavy duty metal of approximately 3/16 of an inch thickness and holds approximately 2½ cubic yards of liquid cement. Disposed directly beneath the hopper is cement supply bin 114. Bin 114 rests upon and is movable along channels 116 by virtue of wheels 118, as seen most clearly in FIGS. 2, 3 and 4. Cement is supplied to bin 114 via opening 120 in the bottom of hopper 112. The rate at which cement flows from hopper 112 is controlled by the hopper door 122 which is pivotally connected to hopper 112 and may be set at various angles with respect thereto to close off the desired section of opening 120. Bin 114 moves along track 116 with the bottom of the bin closed off by plate 124 which extends up to female die 128. On movement of bin 114, wiper 126 cleans plate 124 of any debris which might hinder progress and also smooths the material which is placed in female die 128.

Motion is imparted to bin 114 by cylinder 130 which is pivotally attached at one end to gusset 132. The piston of cylinder 130 is attached pivotally to lever arm 134 which in turn is connected to a rod 135 which is shown in FIG. 3 and extends through the entire width of the machine. Rod 135 is journalled by bearings 142 and is connected to two arms 136. Each arm 136 is pivotally connected to an arm 138 which is connected to bin 114 at bearing point 140 and forces longitudinal movement of bin 114. Consequently, it may be seen that as the piston of cylinder 130 extends outwardly from 132, lever arm 134 moves lever arm 136 pivotally about bearings 142 and this in turn moves lever arm 138 and the bin 114 in the direction toward female dies 128. As bin 114 moves over dies 128, the latter are filled with liquid cement. To insure efficient transference of cement from the bin to the dies, the bin is made to move to the full extent of its travel, retrogress, and move to the full extent of its travel once again whereupon it returns to its original position.

For vertical movement of both the male and female dies, four support shafts 144 are provided as seen in FIGS. 2, 3 and 4. In the case of the male dies 146, bushings 148 ride on support shafts 144 and support cross beams 150 to which male dies 146 are attached. Vertical motion is imparted to the male dies 146 by hydraulic cylinder 152 which is pivotally attached to the machine frame at point 154. Piston 156 of hydraulic cylinder 152 is attached to a cross member 158 which is in turn connected to vertical supports 160 which are connected to cross member 150. In this manner, upon actuation of cylinder 152, piston 156 extends therefrom lifting supports 160 which is turn lift cross beams 150 which ride upon support shafts 144 thus lifting male dies 146. After return of bin 114 to its home position, male dies 146 are lowered by virtue of piston 152 into female dies 128 in order to tamp or compact the liquid cement located therein.

Coincident with the lowering of the male dies to perform the compacting process, vibrators 162 as shown in FIGS. 2, 4 and especially 5, are caused to vibrate to aid in the compacting and settling process. These vibrators are attached to the female dies and are operated via pulleys 164, belts 166 and electric motors 168, as shown in FIGS. 2, 3 and 4. Electric motors 168 are mounted on platforms 170 and supported by arms 172 and pipe 174 in order to compensate for any extraneous vibratory movement of the motors due to the vibration of the vibrator 162. Thus, it can be seen that the vibrating and compacting process of the liquid cement is carried on at the same time by virtue of vibrators 161 and male die portion 146.

After the compacting process is complete, female die 128 is lifted to a position above the formed cement product. Vertical movement of female die 128 is accomplished by bushings 176 which ride on support shafts 144 below the limits of travel of bushings 148. Female dies 128 are attached to plates 178 which are firmly connected to bushings 176. The dies are removably attached to these plates as, for example, by nuts and bolts. The upper ends of these plates are attached to connecting rods 180. It will be seen from the drawings that the portions of channel 116 which are over the female dies 128 are also connected to plates 178 and ride vertically therewith, channels 116 being split for this purpose. Motion is imparted to the female dies by hydraulic cylinder 182, as seen in FIGS. 2, 3 and 4. It may be seen that hydraulic cylinder 182 is pivotally connected to the upper portion of the machine frame at point 184. The piston of cylinder 182 is connected to arm 186 which in turn is connected to rod 188 which extends for the width of the machine and is journaled by bearings 190 as can most readily be seen with reference to FIG. 3. Arms 192 extend from rod 188 and attach to the upper portion of connecting rods 180. In this manner, when the piston of cylinder 182 is extended from cylinder 182, arm 186 is forced downward while arms 192 are forced upward about 188 and connecting rods 180 move upward carrying with them female dies 128. This upward movement of female dies 128 takes place immediately subsequent to the vibrating and compacting of liquid concrete in the female dies.

Subsequent to the upper movement of the female dies 128, an upward movement of the male dies 146 is begun whereupon male dies 146 are brought to their home position. At this point, the formed and compacted cement product is resting on a platform beneath the machine and is free from obstructions. At this point, power is provided to the drive wheels of the machine whereupon the machine moves rearward a specified amount at which time female dies 146 are again returned to their home position resting on a platform below the machine. At this point, the entire sequence is begun anew with rearward movement of bin 114 and the depositing of liquid cement within the female dies.

Power is transmitted to the drive wheels by hydraulic motor 194 shown in FIG. 4 at the front of the machine. Motor 194 drives gear box 196 which is in turn connected via a chain drive to gear 198 which is attached to central shaft 200 which extends between the forward wheels 110. Thus, power is transmitted from hydraulic motor from 194 through gear box 196 to sprocket gear 198 to shaft 200 and through shaft 200 to the rearward wheels 110.

When it is desired to turn the cement forming machine in order to change the direction of travel, a fifth wheel 202 shown in FIG. 4 is lowered to the ground and raises the rear of the machine vertically approximately 2 inches. Power is provided for this lifting process by cylinder 204 which is attached to the main frame of the machine with the piston thereof being attached to the fifth wheel 202. Upon downward movement of the fifth wheel 202, beveled gears which are attached thereto, come into contact with gears located in gear box 196 to thereby impart rotary motion to the fifth wheel 202. In this manner, when the fifth wheel is lowered, the rear of the machine is raised allowing rear wheels 110 to rotate freely while the fifth wheel 202 imparts lateral movement to that end of the machine thus enabling right or left-hand turns to be accomplished by the machine.

Figure 5:
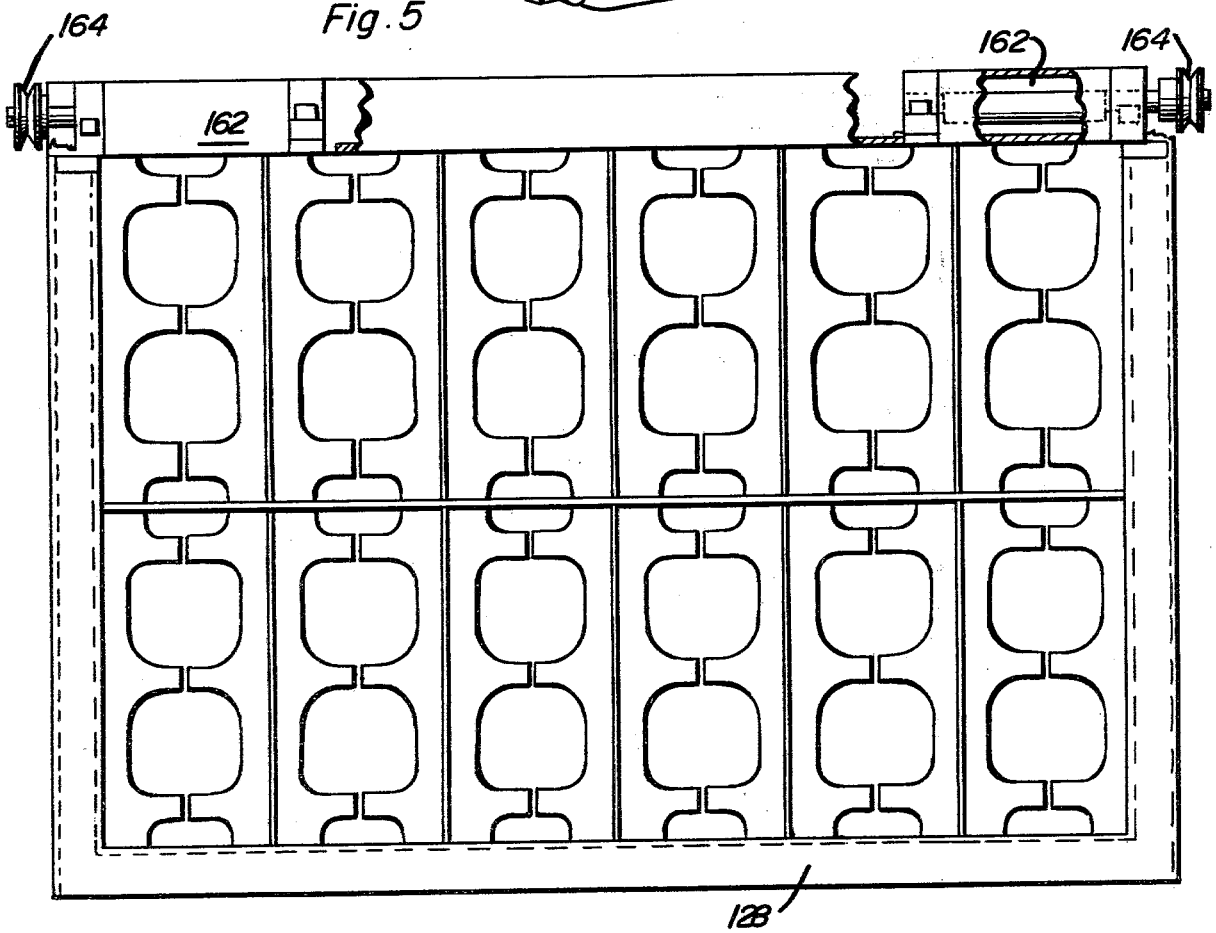
FIG. 5 is a plan view of the female dies used to produce one course of standard cement blocks.

Thus, it may be envisioned that the entire device may be placed in the automatic mode whereupon bin 114 moves to the right as seen in FIG. 4 depositing liquid cement in the female dies and makes one retrogression prior to moving to its home position. When bin 114 is located in its home position, limit switches are actuated which initiate the downward movement of male die 146. Male die contacts and compresses the liquid cement at the same time as vibrators 162 are actuated, thus aiding in the compaction process. When the male die is lowered to the proper point to indicate sufficient compaction of the liquid cement, a limit switch is hit which stops the vibratory movement of vibrators 162 and initates upward movement of female die 128. When female die 128 is lifted, a limit switch is hit which initiates lifting of male die 146. When male die 146 is in its home position, a limit switch is hit which activates hydraulic motor 194. At this point, the machine moves rearward a specified amount, and female die 128 is lowered into its home position once again. At this point, a timer starts the cycle over again, with the movement of the bin 114. In this manner, the machine may be placed upon any hard surface and a series of cement products may be formed as determined by the shape of the die used in the forming process. As, for example, FIG. 5 shows, the die could be used for the manufacture of standard cement blocks. As the machine approaches the end of the hard surface upon which the products are formed, an operator may manually actuate the fifth wheel 202 in order to turn the machine by the desired amount to allow continued forward movement thereof. In this manner, an entire series of cement products may be placed upon a hard surface for the curing thereof.

Figure 8:
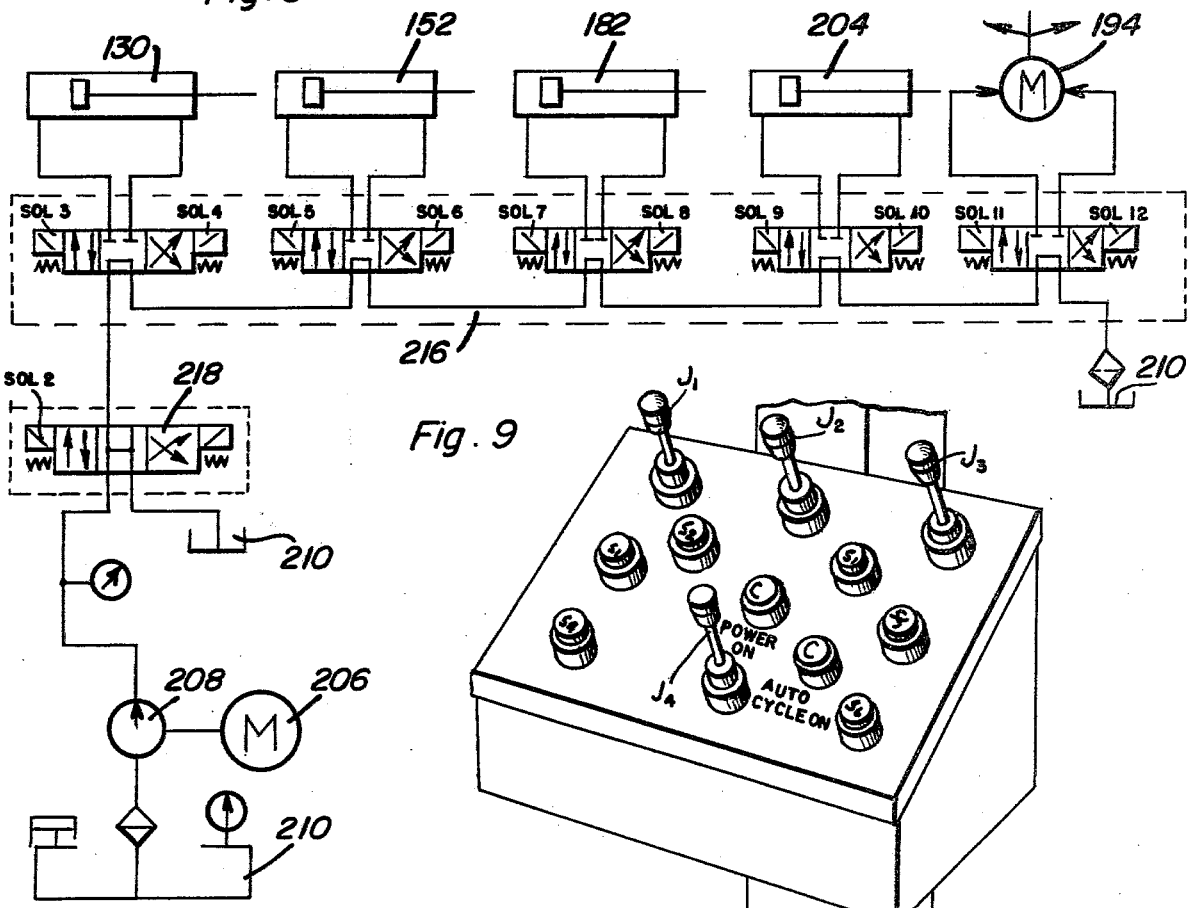
FIG. 8 is a schematic of the hydraulic circuit of the cement forming machine.

Referring again to FIGS. 2, 3 and 4, it will be seen that an electric motor 206 is positioned on the top of the cement forming machine and is connected to an hydraulic pump 208. Motor 206 and pump 208 provide the source of hydraulic pressure for the hydraulic cylinders of the system. Pump 208 is in communication with the hydraulic tanks 210 which are disposed immediately below the pump. The function of motor 206 and pump 208 will be more apparent with reference to FIG. 8 wherein the hydraulic circuit of the machine is presented in schematic form. In FIG. 8 sumps 210 are shown as being in communication with pump 208. Pump 208 supplies hydraulic fluid to the series of valves positioned on manifold 216 through control valve 218. Control valve 218 has an open center provided to allow the hydraulic fluid to return to sump 218 when none of the cylinders 130, 152, 182, 204 and hydraulic motor 194 are being used. However, whenever any of these hydraulic devices are to be placed in use, solenoid SOL 2 is activated thus allowing hydraulic fluid to be transmitted to the proper valve. As will be apparent from FIG. 8, actuation of the proper solenoid SOL 3 through SOL 12 will affect either forward or reverse motion of the appropriate hydraulic device. The valves used are standard 3-position, 4-way hydraulic valves with one valve being provided for each hydraulic cylinder used and one valve being provided for hydraulic motor 194. The actuation of the appropriate solenoid and/or motor is accomplished by the control circuit which is schematically set forth in FIG. 6.

Figure 6:
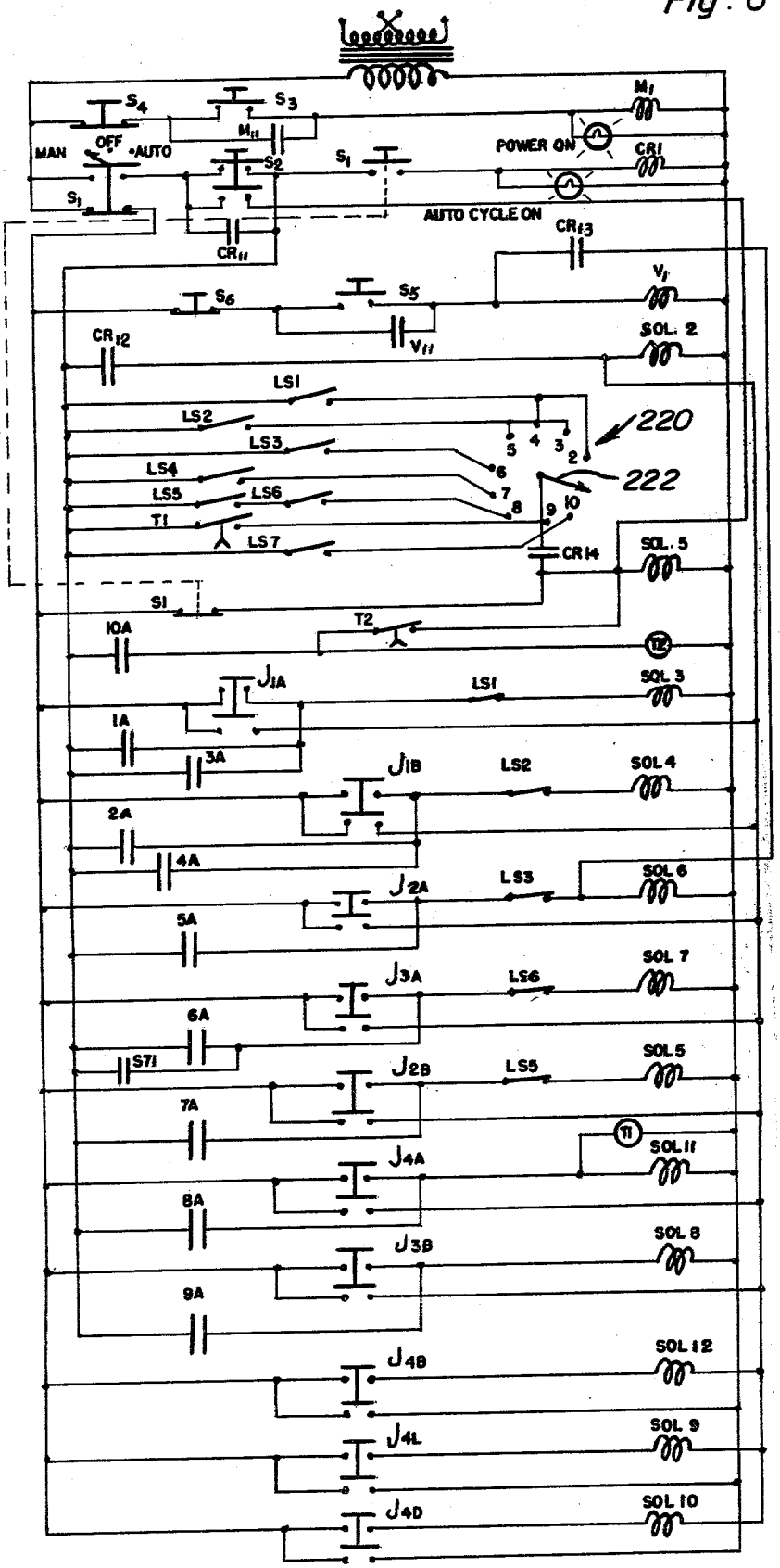
FIG. 6 is a schematic diagram of the control circuit of the cement forming machine.
Figure 9:
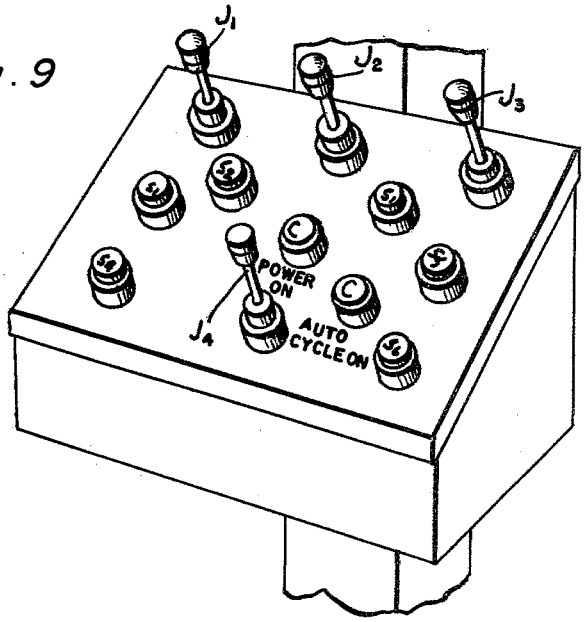
FIG. 9 shows the manual control panel of the cement forming machine.

Now, with reference to FIG. 6 and FIG. 9, the control circuit and control panel of the present invention will be more clearly explained. A three-position switch S1 is provided for the operator to choose either off, manual or automatic modes of operation. Switch S1 is ganged to three switches in the circuit. With S1 in the off position, all three switches are open. As shown in the diagram of FIG. 6, S1 is in the manual position. With S1 in the automatic position, the switches would be in reverse orientation. For operation of the device, appropriate selection of switch S1 is made and switch S3 is depressed whereupon relay M1 is actuated. M1 closes contacts M11 and starts operation of the hydraulic supply motor 206 and the pump 208. At this point, the various operations of the machine may be performed by use of the joy stick controllers shown in FIG. 9 and schematically shown in FIG. 6. As seen in FIG. 6, joy stick J1 has two operative positions wherein in one position the contacts labelled J1A, are closed and J1 operates solenoid SOL 3. In its second position, contacts J1B, are closed and joy stick J1 operates solenoid SOL4. With reference to FIG. 8, it may be seen that solenoid SOL3 and SOL4 actuate the valve which operates hydraulic cylinder 130 which provides power for movement of bin 114. Joy stick J2 again has two operative positions. In one position, with contact J2A closed, J2 operates solenoid SOL6 and in the second operative position, solenoid SOL5 is actuated. These solenoids actuate the valve which operates cylinder 152 which provides vertical motion for the male die. In like manner, joy stick J3 operates solenoids SOL7 and SOL8 which operate the valve which actuates cylinder 182 for movement of the female die. Joy stick J4 is operative to control motion of the machine. Joy stick J4 is a 4-position controller and operates the contacts designated as J4A-J4D. Joy stick J4 operates solenoids SOL9-SOL12 which operate the valves which control the fifth wheel cylinder 204 and hydraulic motor 194. Joy stick J4 may operate any of the switches J4A-J4D individually or two of these switches simultaneously. In this manner, hydraulic motor 194 may be operated by switch J4A through solenoid SOL 11 for forward motion of the machine, switch J4B through solenoid SOL 12 for rearward motion of the machine, or solenoid SOL9 and SOL11 may be actuated simultaneously for movement of the machine to the right, and solenoid SOL9 and SOL12 may be actuated for motion to the left. It will also be noted that upon each manual actuation of one of the solenoids SOL3-SOL12, an additional set of contacts is closed, which contacts actuate solenoid SOL2 which controls the main control valve 218 of the hydraulic system. Switch S5 may be depressed to actuate solenoid V1 and thereby initiate operation of the vibrators. Depression of switch S6 would deactivate vibrators 162.

Figure 7:
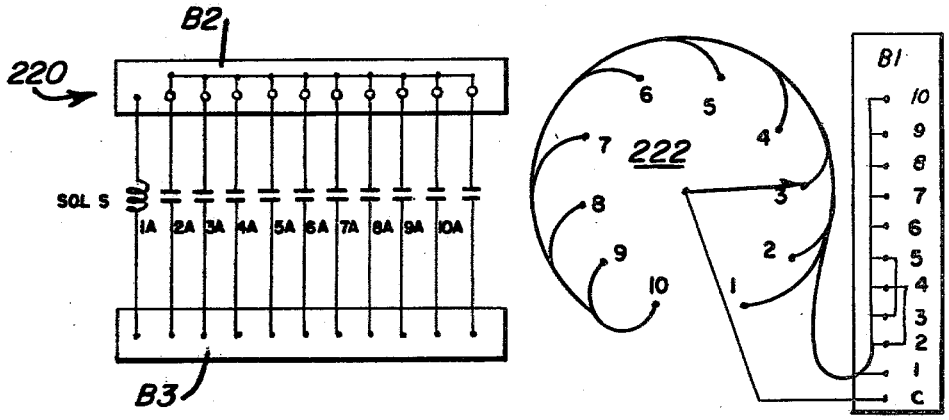
FIG. 7 is a schematic circuit showing the step switch which are used in the control circuit of FIG. 6.

The automatic control of the system is effected under the guidance of step switch 220 shown in FIG. 7. The operation step switch 220 is based upon sequential actuations of solenoid SOLS. As shown in FIG. 7, wiper 222 of step switch 220 is positioned at position 3. This provides for a continuous path between point C and point 3 of terminal block B1. At the same time, contacts 2A shown as connected between terminal blocks B2 and B3 are closed. Upon actuation of solenoid SOLS, wiper 222 will advance to position 4 whereupon contacts 3A will close and contacts 2A will open. Upon the next sequential actuation of solenoid SOLS, wiper 222 will advance to point 5 and solenoid 4A will close and solenoid 3A will open. This continues on in a cyclic manner throughout the progression of points of 1-12 and then the progression begins again with point 1.

Bearing the operation of step switch 220 in mind, automatic control will now be explained with reference to FIG. 6. With switch S1 in the automatic position, the circuit to control relay CR1 may be completed by depression of switch S2. At this point, the auto cycle light would begin to glow. Upon depression of switch S3, relay M1 would start motor 206 and the power-on light would glow. Control relay CR1 would close normally open contacts labelled CR11, CR12, CR13 and CR14. Contacts CR11 serve to hold relay CR1 in an activated state. Contact CR12 serve to hold solenoid SOL2 in an activated state thus initiating operation of hydraulic pump motor 206. Contacts CR13 serve to close a circuit to solenoid V1, which operates vibrator motor 168, with the initiation of operation of solenoid SOL6. Contacts CR14 serve to bring the wiper of step switch 220 into electrical communication with the rest of the circuit. Actuation of switch S2 simultaneously closes a second set of contacts which provide an initial activation of solenoid SOLS. The activation of solenoid SOLS serves to step wiper 220 to position 2 and produces a closure of switch contacts 1A. Upon closure of contacts 1A, solenoid SOL3 is activated whereupon piston 130 is extended and the bin 114 is moved to a position over the female dies 128. Upon reaching its position over these discs, a limit switch LS1 is activated. Limit switch LS1 has one set of normally open contacts in line 2, position 2 of step switch 220 and one set of normally closed contacts in the circuit with solenoid SOL3. Thus, limit switch LS1 simultaneously disconnects solenoid SOL3 from the circuit and activates solenoid SOLS through contact 2 and wiper 220 and contacts CR14 which are now closed. Consequently, wiper 222 advances to position 3 and closes contacts 2A. Contacts 2A energize solenoid SOL4. Solenoid SOL4 activates return motion of piston 130 until limit switch LS2 is encountered. Limit switch LS2 simultaneously deactivates solenoid SOL4 and produces an activation of solenoid SOLS through contact 3 and wiper 222 and contacts CR14. This activation of the solenoid moves wiper 222 to position 4 of the step switch 220 and closes contacts 3A. Contacts 3A once again initiate forward movement of piston 130 until limit switch LS1 is activated whereupon wiper 222 advances to position 5 and contacts 4A engage. Contacts 4A once again initiate movement of bin 14 to its home position whereupon limit switch LS2 is activated moving wiper 222 to position 6 and activating contacts 5A. Contacts 5A activate solenoid SOL6 which initiates downward movement of male dies 146 for the tamping and compacting process. At the same time through contacts CR13, solenoid V1 is activated. V1, as discussed, activates vibrator motors 168 and therethrough vibrators 162. When the liquid cement is compacted sufficiently, the male dies will have lowered the point of limit switch LS3, whereupon solenoid SOL6 will be deactivated and wiper 222 will advance to position 7 and contacts 6A will be closed. Closure of contacts 6A activates SOL7 which effect closure of contacts S71 and activates cylinder 182 which raises the female dies. When the female dies are in a position above the formed cement product, limit switch LS4 is activated which advances wiper 222 to position 8 and contacts 7A are closed. With contacts 7A closed, solenoid SOL5 is activated and cylinder 152 begins to lift male dies 128 to their home position. When female dies are in their uppermost position, limit switch LS6 is actuated thus deactivating solenoid SOL7. When male dies 128 reach their home position, limit switch LS5 is actuated thus deactivating solenoid SOL5. With both dies in their up position, limit switches LS5 and LS6 are actuated thus advancing wiper 222 to position 9 and closing contacts 8A. With contacts 8A closed, solenoid SOL11 is activated thus providing power to hydraulic motor 194 and imparting forward motion to the machine. Forward motion of the machine is continued until timer T1 times out whereupon contacts T1 are closed and wiper 222 is advanced to position 10 whereupon contacts 9A are closed. With contacts 9A closed, solenoid SOL8 is activated and female dies 128 are returned to their home position on the surface beneath the cement forming machine. When the female dies reach their home position, limit switch LS7 is activated thus advancing wiper 222 to position 1 and closing contacts 10A and activating timer T2. When timer T2 times out, contacts T2 close thereby advancing wiper 222 to position 2 and initiating the cyclic procedure once again. This cycle will be followed until switch S1 is placed in the off position. At this point relay CR1 is deactivated and the machine is turned off.

Also it will be seen that with switch S1 in the manual position, the switch may be depressed periodically thereby cycling step switch 220 through the various contacts thereof without operating the associated component, thereby enabling proper setting of the controller for automatic operation of the machine if stopped in mid-cycle.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Apparatus for producing shaped cement products comprising:

a female die means for receiving a fluid cement to form said shaped cement products;

first lifting means for lifting said female die means to a position vertically spaced from the shaped cement products;

a machine body to which said female die means and said lifting means are attached;

motive power means connected to said machine body for moving said machine body to a position horizontally spaced from said formed cement products and including a plurality of wheels attached to said body wherein at least one of said wheels has a motor attached thereto for providing power for motion of said body;

control means for maintaining said female die in said vertically spaced position while said motive power means is operative to move said machine body;

male die means for positioning in said female die means to compress and form the liquid cement to the shape of the female die means;

second lifting means connected to said body and operatively engaged with said male die means for imparting upward and downward vertical motion to the male die means; and wherein said control means is operatively engaged with said second lifting means to maintain said male die means in a vertically spaced position from said formed cement product when said body is moved to said horizontally spaced position;

delivery bin means for delivering liquid cement to said female die means and depositing said liquid cement into said female die means;

a hopper for holding a large supply of liquid cement, said hopper being disposed in a position spaced vertically from said delivery bin;

bin movement means for moving said bin means from a position immediately below said hopper to a position over said female die means and moving said bin means to a position horizontally spaced from said female die means to a position immediately below said hopper when said female die means is filled with cement; and wherein said control means is operative to control said bin movement means to insure that said bin means is in a position horizontally spaced from said female die means when either of said first or second lifting means is actuated;

vibrating means operatively engaged with said female die means to impart vibratory motion thereto.

2. The apparatus of claim 1 wherein said control means is operative to automatically produce sequential actuation of said first lifting means to lift said female die means above said formed cement product, activate said power motive means to move the body to a new location and lower said female die after the new location of said body has been reached.

3. The apparatus of claim 2 wherein said control means comprises a stepping switch means wherein each next sequential operation commanded by said stepping switch is conditioned on the completion of the previous operation commanded by said switch.

4. The apparatus of claim 3 wherein the completion of an operation is signalled by actuation of a limit switch.

5. The apparatus of claim 2 including means to disengage the automatic control and effect manual operation of the apparatus.

6. The apparatus of claim 2 wherein said control means includes a bin retrogression circuit means for producing at least one retrogression of said bin means for smoothing the liquid cement in said female die means.

7. The apparatus of claim 1 and further wherein said bin means includes a leading edge, a wiper means attached to said leading edge for smoothing the liquid cement poured in said female die means.

8. The apparatus of claim 7 and further wherein said bin movement means includes support rollers attached to said bin, a track connected to said frame for guiding said support rollers, said track including a forward portion and a rearward portion, said rearward portion being connected for movement with said female die means, said forward portion being connected for alignable with said rearward portion for guiding said bin means over said female die means, and spaced below said rear portion when said female die means are in their vertically spaced position.

9. The apparatus of claim 1 wherein said female die means and said male die means are mounted for vertical movement on common vertical support shafts mounted to said frame, said female die means being mounted above said male means.

10. A mobile, automatic cement product forming device comprising:

a main frame;

a stationary hopper for containment of liquid cement attached to said frame;

a dispensing bin disposed below the hopper to accept liquid cement from the hopper and adapted for horizontal motion along the frame;

a female die means for accepting liquid cement from the dispensing bin and forming said cement into the final product, said female die means adapted for vertical motion within the frame;

a male die means disposed vertically above said female die means and adapted for vertical movement within said frame for engagement with said female die means for pressing and compacting liquid cement disposed within said female die means;

a plurality of wheels attached to the frame for allowing horizontal movement of the apparatus;

power means operatively connected to at least one of said wheels to provide powered movement of the apparatus; and automatic control means for providing automatic control for the formation of the cement product and automatic horzontal movement of the apparatus after the formation of the cement product, for moving said dispensing over said female die means and causing dispensing bin to make one retrogression prior to moving to its initial position, and moving said male die means vertically downward into contact with said liquid cement, lifting said female die means to a first position, lifting said male die means to its vertical position, and energizing said power means for causing a predetermined forward movement of the device, lowering the female die means, and renewing the cycle of operation.

11. The apparatus of claim 10 wherein said automatic control means comprises a stepping switch with sequential advancement of said stepping switch in response to the closing of one of a plurality of limit switches.

12. The device of claim 10 wherein said plurality of wheels includes four wheels aligned in a common direction for producing forward and rearward motion of the device and a fifth wheel mounted in a perpendicular orientation to said four wheels for allowing turning of the device.

13. The device of claim 12 wherein said fifth wheel is mounted for displacement between a vertical position out of ground contact for allowing forward and rearward motion of the device, and a lower position in ground contact for causing rotational motion of the device.

14. The device of claim 13 wherein said predetermined forward movement is controlled by a timer means, with the duration of said timer being indicative of the length of travel of said device.

* * * * *